US009205439B2

(12) United States Patent
Goettke et al.

(10) Patent No.: US 9,205,439 B2
(45) Date of Patent: Dec. 8, 2015

(54) DISPENSER

(75) Inventors: Sabine Goettke, Lohne (DE); Martin Presche, Dinklage (DE)

(73) Assignee: RPC Bramlage GmbH, Lohne (DE)

( * ) Notice: Subject to any disclaimer, the term of this patent is extended or adjusted under 35 U.S.C. 154(b) by 0 days.

(21) Appl. No.: 14/006,372

(22) PCT Filed: Mar. 21, 2012

(86) PCT No.: PCT/EP2012/054934

§ 371 (c)(1),
(2), (4) Date: Nov. 19, 2013

(87) PCT Pub. No.: WO2012/126920

PCT Pub. Date: Sep. 27, 2012

(65) Prior Publication Data

US 2014/0061243 A1 Mar. 6, 2014

(30) Foreign Application Priority Data

Mar. 23, 2011 (DE) ..... 10 2011 001 512

(51) Int. Cl.
*B05B 11/00* (2006.01)
*B05B 15/10* (2006.01)

(52) U.S. Cl.
CPC ..... *B05B 11/3001* (2013.01); *B05B 11/3053* (2013.01); *B05B 11/3047* (2013.01); *B05B 11/3074* (2013.01); *B05B 15/10* (2013.01)

(58) Field of Classification Search
CPC ..... B05B 11/3053; B05B 11/3047; B05B 11/3074
USPC ..... 222/321.7–321.9, 534, 536
See application file for complete search history.

(56) References Cited

U.S. PATENT DOCUMENTS

| | | | | |
|---|---|---|---|---|
| 4,991,744 | A * | 2/1991 | Von Schuckmann | 222/136 |
| 5,016,783 | A * | 5/1991 | Hayes et al. | 222/153.13 |
| 5,085,347 | A * | 2/1992 | Hayes et al. | B05B 11/0032 222/153.02 |
| 5,203,841 | A * | 4/1993 | Kitabayashi | B65D 47/2043 222/402.11 |
| 6,158,625 | A | 12/2000 | Siegel et al. | |
| 6,991,135 | B2 * | 1/2006 | von Schuckmann | 222/209 |
| 8,439,230 | B2 | 5/2013 | Hagen | |
| 8,690,022 | B2 * | 4/2014 | Lee | 222/321.6 |
| 2011/0031282 | A1 | 2/2011 | Hagen | |

FOREIGN PATENT DOCUMENTS

WO WO 2009/127651 A1 10/2009

OTHER PUBLICATIONS

International Search Report of PCT/EP2012/054934, Jun. 14, 2012.

* cited by examiner

*Primary Examiner* — Daniel R Shearer
(74) *Attorney, Agent, or Firm* — Collard & Roe, P.C.

(57) ABSTRACT

A dispenser for liquid to pasty substances has a pumping chamber and a dispensing tube movable between a rest position and a dispensing position during pumping. In the rest position a covering part connected to the dispenser covers a dispensing opening of the dispensing tube. During pump actuation, at least part of the dispensing tube moves perpendicular to the pumping movement while traversing the movement path of the covering part, which simultaneously moves relative to the dispensing tube. The covering part can be inwardly offset from a dispenser wall part that has a window-like opening associated with the covering part. In the rest position the covering part can be aligned with the opening. In the dispensing position the covering part can at least partially uncover the opening to expose at least part of the dispensing tube in the opening to discharge substance through the opening.

11 Claims, 10 Drawing Sheets

DISPENSER

CROSS REFERENCE TO RELATED APPLICATIONS

This application is the National Stage of PCT/EP2012/054934 filed on Mar. 21, 2012, which claims priority under 35 U.S.C. §119 of German Application No. 10 2011 001 512.4 filed on Mar. 23, 2011, the disclosure of which is incorporated by reference. The international application under PCT article 21(2) was not published in English.

The invention relates to a dispenser for liquid to pasty substances, having a pumping chamber and a dispensing tube, the dispensing tube being moved between a rest position and a dispensing position during a pumping movement, and in the rest position a dispensing opening of the dispensing tube being covered by a covering part connected to the dispenser.

Dispensers of this kind have been disclosed in various respects. Reference is made to US 2011/0031282 A1 (WO 2009/127651 A1) by way of example.

There is a need to design a dispenser of this type which can be easily actuated in an advantageous manner.

This gives rise to the object of improving a dispenser for liquid to pasty substances of the kind specified such that it can be conveniently operated, and an advantageous dispensing and rest configuration is provided for the user.

According to a first concept of the invention, a possible solution to the problem is provided by a dispenser in which the aim is to move at least part of the dispensing tube, in the course of actuating the pump, in a direction perpendicular to the pumping movement while traversing the path of movement of the covering part, which at the same time is moved relative to the dispensing tube. Due to the dispensing tube being moved perpendicularly or in any case at least partially perpendicularly with respect to the pumping movement in the course of actuating the pump, the dispensing tube is able to assume a projecting or retracted position. The traversal of the movement path of the covering part, which, in absolute terms, can also be accomplished at rest as a result of the relative movement with respect to the dispensing tube when this is also moved vertically, enables the dispensing tube to be moved in front of the covering part or for it to be disposed in a second position behind the covering part. In the rest position, it is useful to locate the dispensing tube behind the covering part. In particular, this enables the dispensing opening itself to be withdrawn from view in the rest position. A dispensing configuration and a rest configuration can be achieved, which may be noticeably different for the user. In particular in the rest configuration, the dispensing tube can be covered, at least in the region of its free end which has the dispensing opening. On the other hand, in the dispensing configuration the dispensing tube can be exposed and at the same time may project.

With regard to a central axis of the dispenser, in particular also in a preferred substantially cylindrical design of the dispenser, the movement, or where applicable the component of the movement, of the dispensing tube perpendicular to the pumping movement is a movement which is predominantly or exclusively in a direction radial to the mentioned longitudinal axis.

As an alternative to the concept just described, the dispensing tube can also move only on the path of movement of the covering part without traversing it or only traversing it by a small amount, so that in the dispensing position no part projects outwardly beyond the covering part.

A further teaching of the invention relates to the arrangement of the covering part, preferably only in combination with one or more features of the preamble of claim 1, if appropriate also with further features of claim 1. In particular, this teaching relates to the association of the covering part with a dispenser wall part. In this respect, it is preferred that the covering part is inwardly offset with respect to the dispenser wall part, that a window-like opening associated with the covering part is formed in the dispenser wall part, that in the rest position the covering part is aligned with the opening, and that in the dispensing position the covering part at least partially uncovers the opening and at least part of the dispensing tube is exposed in or associated with the opening in order to deliver substance through the opening. In the rest position, the dispensing tube is closed off in the manner of a visor. This is achieved by the covering part which, in the rest position, at the same time covers a window-like opening in the dispenser wall part. The inward view into the dispenser is thus preferably completely obstructed. In the dispensing position, the dispensing tube, the front tip of which has the dispensing opening, can either be arranged projecting forward through the window-like opening or be located in or behind the window-like opening. In any case, the path for the substance is provided by the window-like opening.

In the described embodiments, only a single dispenser actuation is required in order to actuate the dispenser and also to move the dispensing tube, namely, merely an actuation by pressing in a substantially vertical direction, which is also usual for dispensers of this kind. For example, no (additional) rotational movement of one dispenser part relative to another dispenser part is required by the user.

Further features of the invention are described and presented below and also in the description of the figures and the drawing, often in their preferred association with the concept already explained above. However, they can also be of significance in association with only one or more individual features, which are described or illustrated here, or independently or in another overall concept.

Thus is preferred that the movement of the dispensing tube is a swiveling movement. In this case, at least part of the dispensing tube is swiveled in the course of actuating the pump. A swivel axis particularly preferably extends perpendicularly with respect to the pumping movement and, as a rule, then also preferably perpendicularly with respect to the mentioned central axis of the dispenser. Preferably, the entire dispensing tube swivels.

In another aspect, however, also independently of the mentioned swivel movement, it can optionally be provided that the dispensing tube has a bend in its progression. When swiveling, the swivel axis can be located in the region of or at the end of a portion of the dispensing tube which extends substantially perpendicularly, for example as regards the rest position.

Furthermore, it is also preferred that an actuating part, which may be acted upon to carry out a pumping movement or which is to be acted upon by the user to carry out the pumping movement, interacts with the dispensing tube in order to move it. The actuating part can either come to press directly on the dispensing tube and/or it can have a slot in which a projection from the dispensing tube, which is formed in the manner of a sliding pin, for example, is guided. The covering part is preferably a dispenser cap or part of the dispenser cap; particularly preferably, it can be acted upon by one or two fingers of a user for the purpose of actuation by pressing.

The covering part is particularly preferably moved primarily or solely in the vertical direction in the course of actuating the pump.

The covering part can be part of a covering wall. The covering wall can also be stationary so that the dispensing tube is only moved relative to this stationary covering part or covering wall in the course of actuating the pump.

The covering part can also be part of the actuating part. It is then moved together with the actuating part. For this purpose, a free space, through which the dispensing tube or a part thereof can move radially outwardly during the pumping movement, can be provided in the vertical direction between a top end of the covering part and a bottom edge of a region of the actuating part which is plate-shaped, for example.

With regard to the possible swivel movement of the dispensing tube, the latter can form part of a swivel joint, for example a thickening in the manner of a portion of a ball which is enclosed in a corresponding socket part which can then be formed on one or more further parts of the dispenser.

In particular, a further part of the swivel joint can be formed in a plunger insert part or in a part which directly forms the pump plunger.

In the event that the movement of the dispensing tube is controlled by a slot, the slot can also be formed in a stationary part of the dispenser. In this case, the dispensing tube, for example, moved under pressure by the actuating part, is moved in the slot in the course of actuating the pump.

The covering part, which in the rest position at least partially removes the dispensing tube from the view of a user, in any case preferably with regard to the dispensing opening, can also at least partially be covered by a dispenser wall part. This dispenser wall part is then preferably provided to be stationary with respect to the dispenser as a whole.

It is also preferred that the dispenser wall part and the covering part are provided laterally offset with respect to one another in a cross-section.

The action on the dispensing tube during a pumping movement can also be directly converted into a pumping movement of a pump plunger.

The invention is explained further below with reference to the attached drawing, which, however, represents only exemplary embodiments. A part which is explained only with reference to one of the exemplary embodiments and is not directly replaced by another part in a further exemplary embodiment due to the special feature highlighted there is therefore also described for this further exemplary embodiment as a part which may in any case be present. In the drawing.

Figure 1:
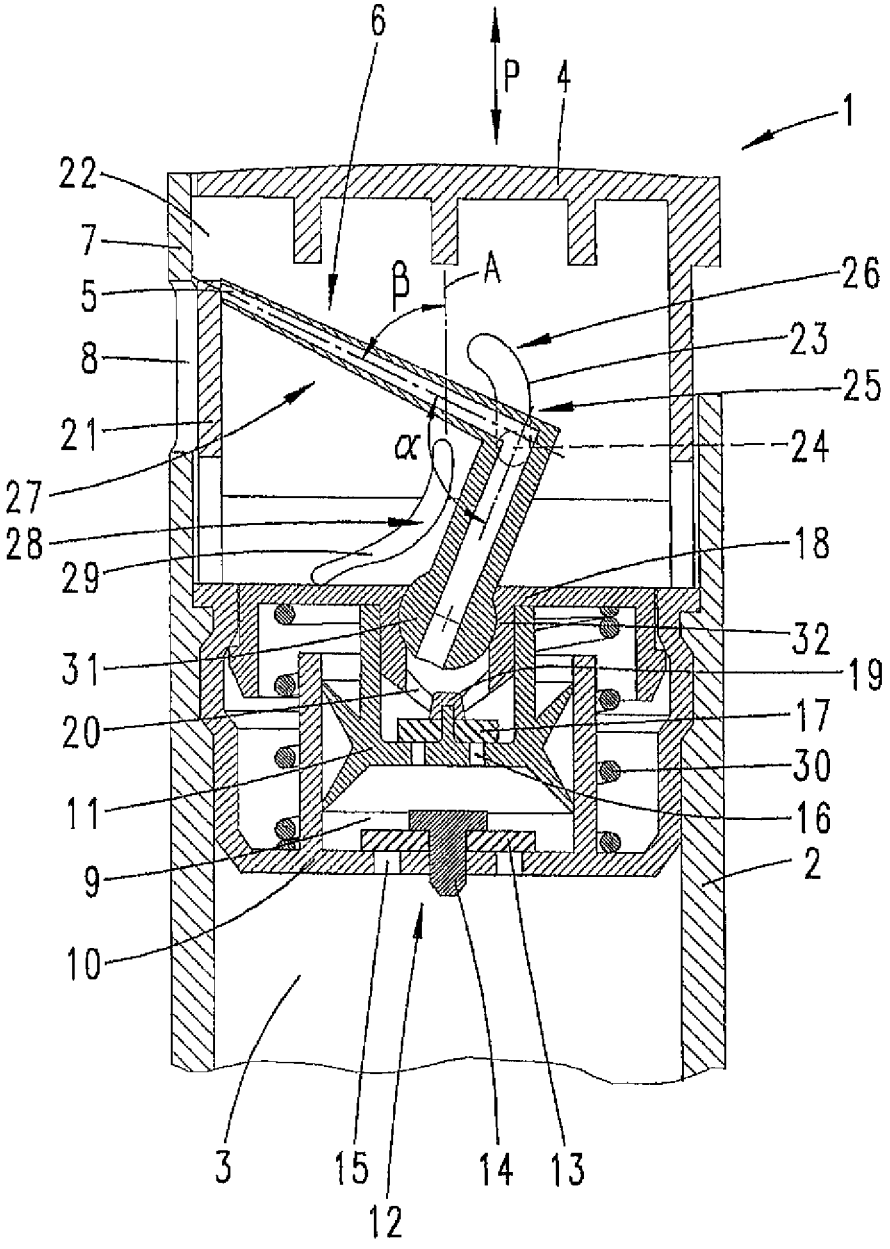
FIG. 1 shows a cross-sectional view of a first exemplary embodiment of the dispenser, in the rest position.
Figure 2:
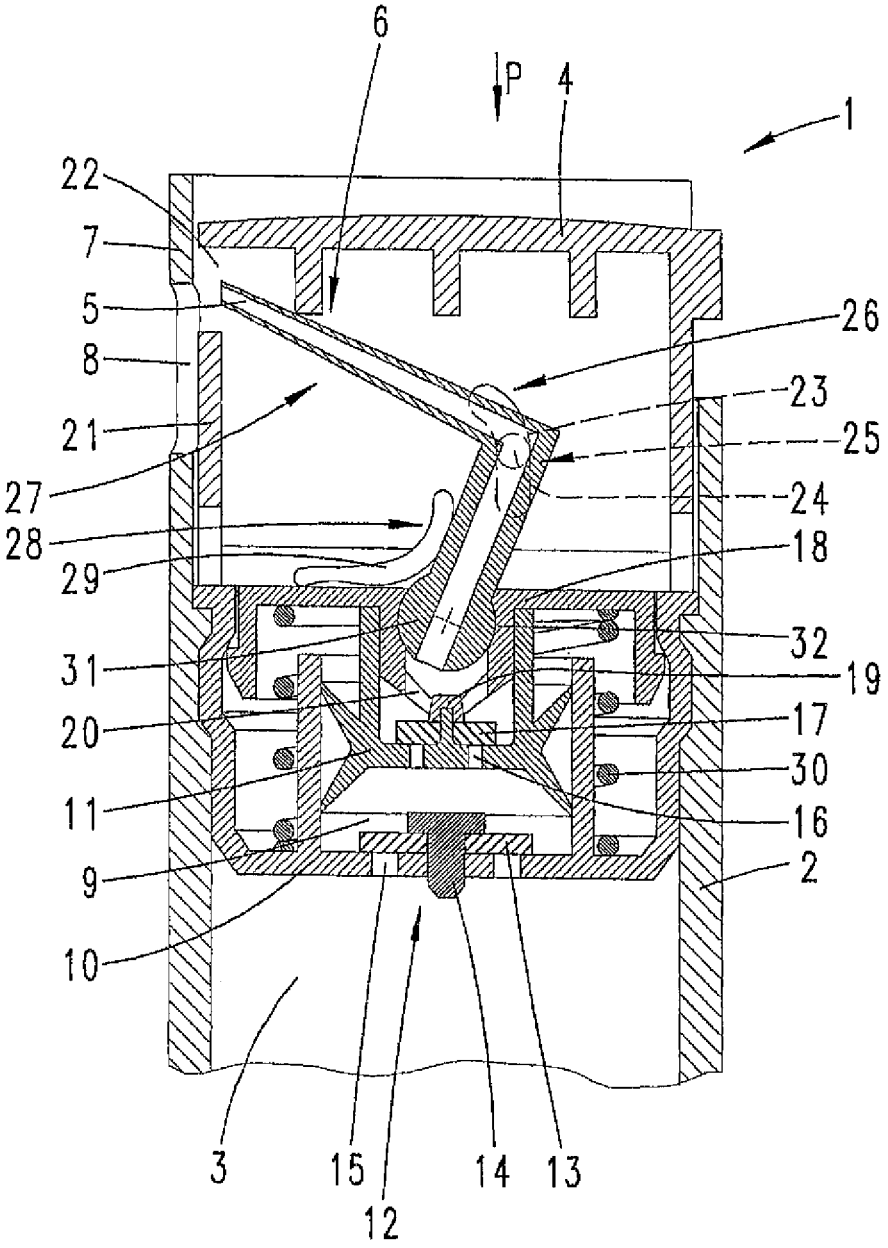
FIG. 2 shows a cross-section according to FIG. 1, after the beginning of pump actuation.
Figure 3:
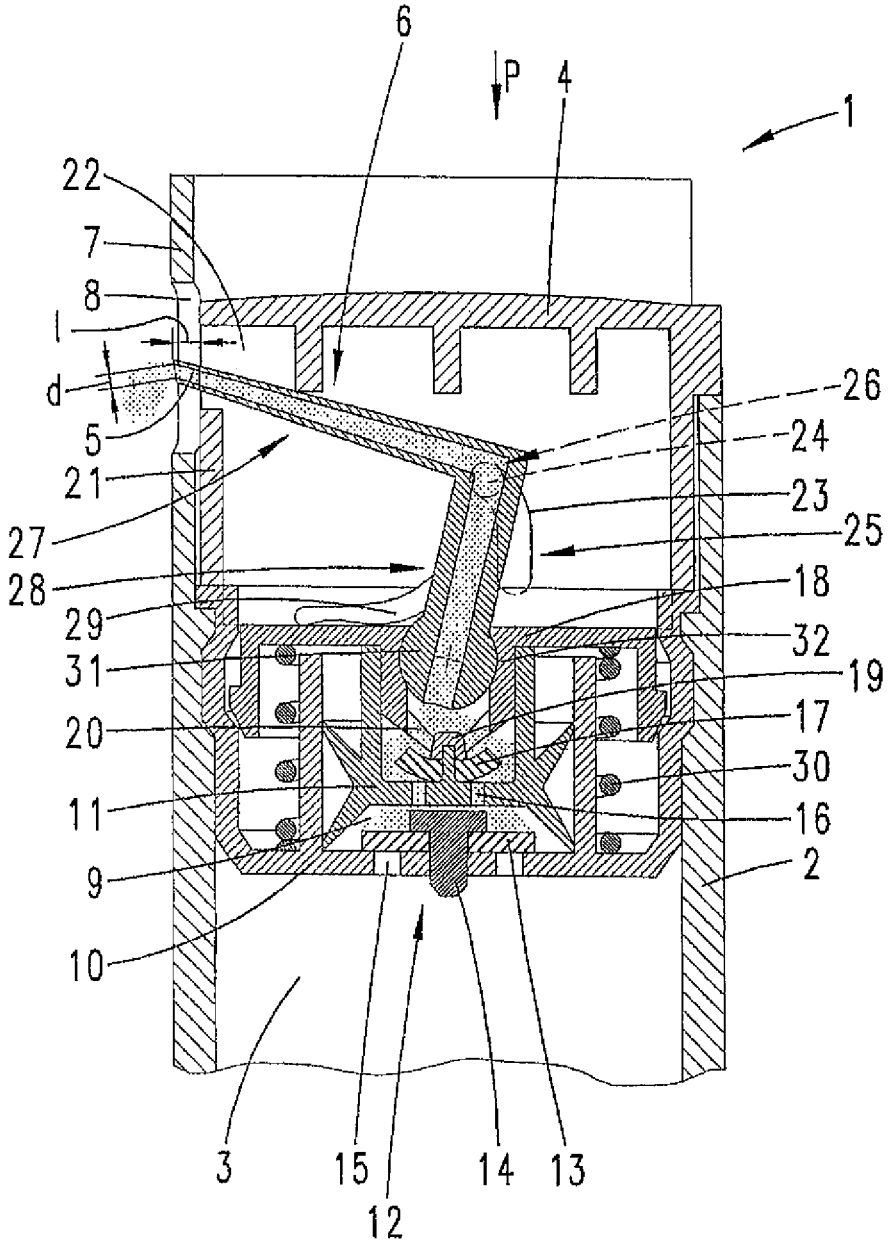
FIG. 3 shows an illustration according to FIG. 1 and FIG. 2 with a fully depressed actuating part (dispensing position) during a pumping movement.
Figure 4:
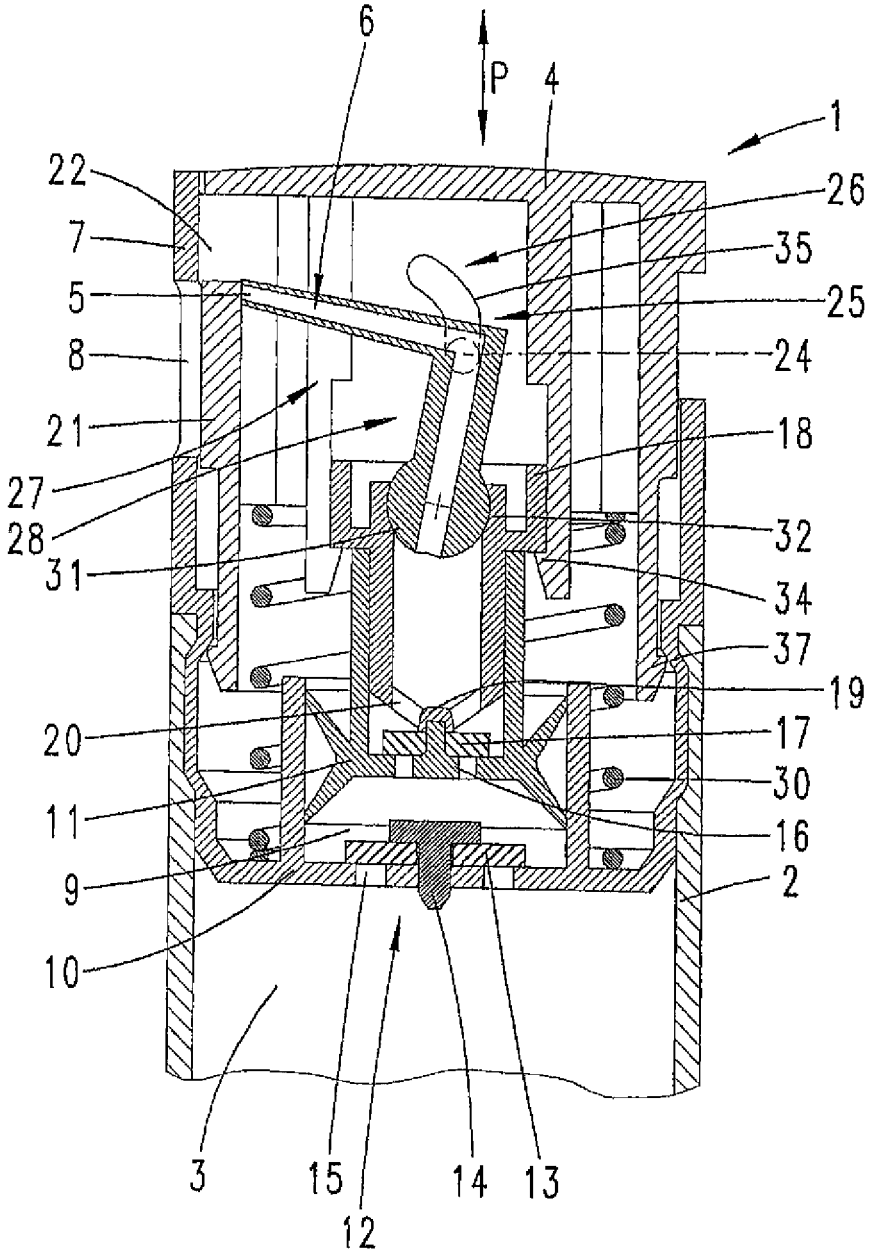
FIG. 4 shows a cross-section corresponding to FIG. 1 of a further embodiment of the dispenser.
Figure 7:
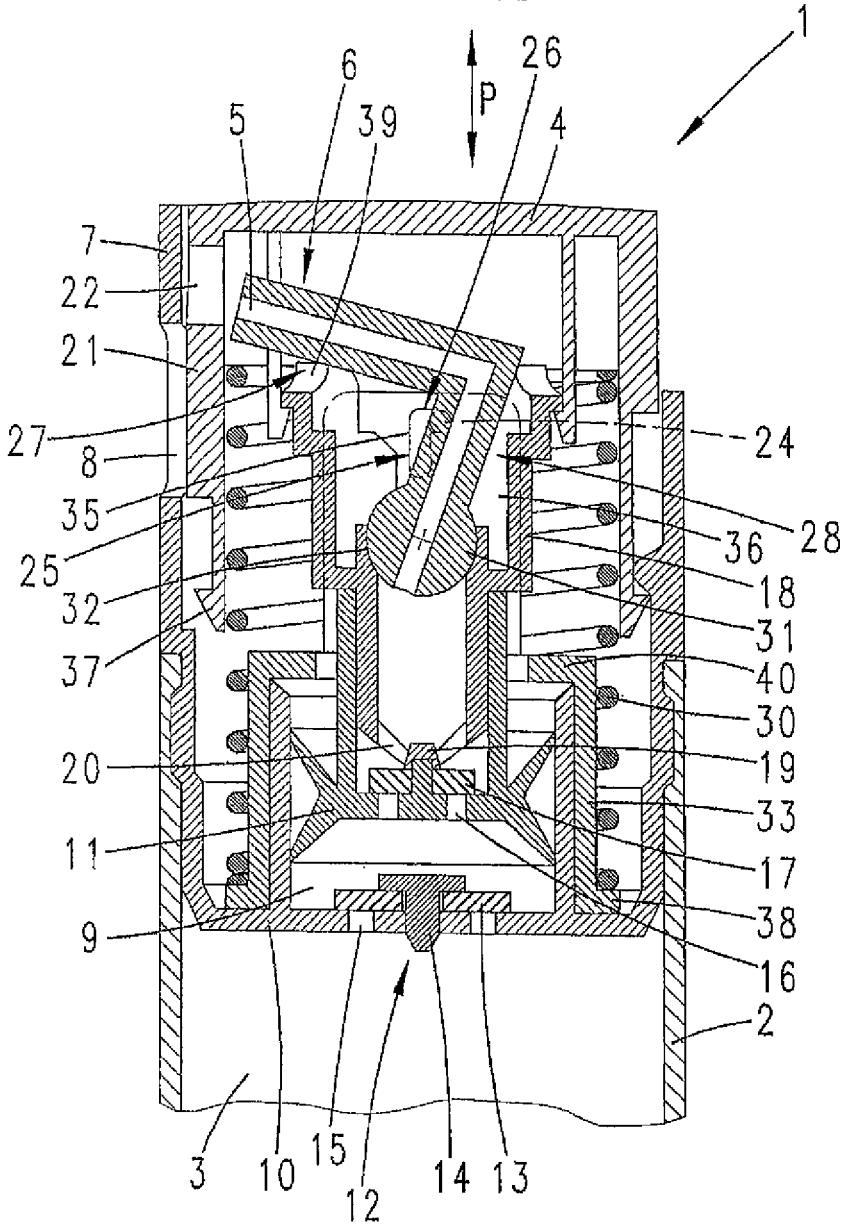
FIG. 7 shows an illustration corresponding to FIG. 1 of a further embodiment of the dispenser.
Figure 10:
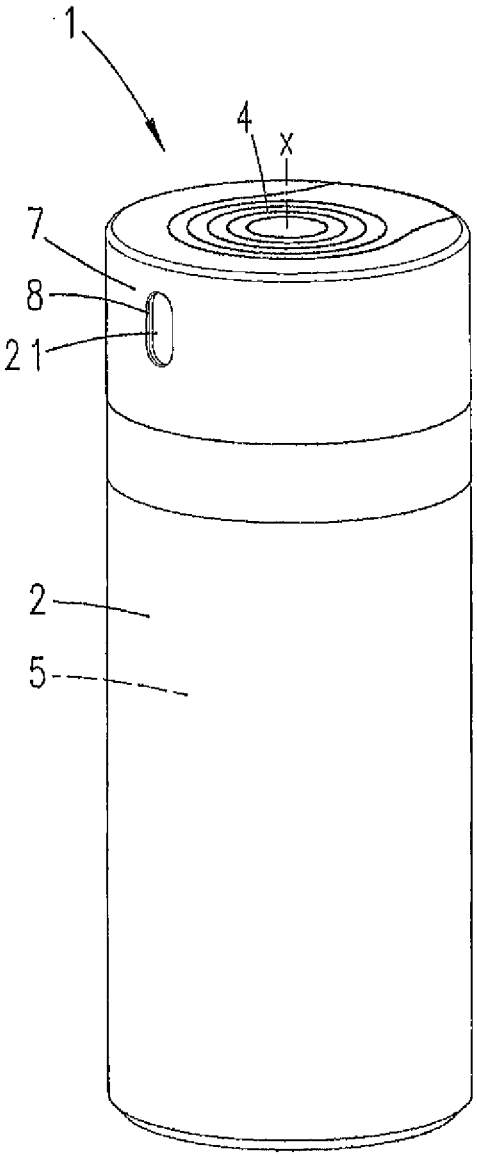
Figure 11:
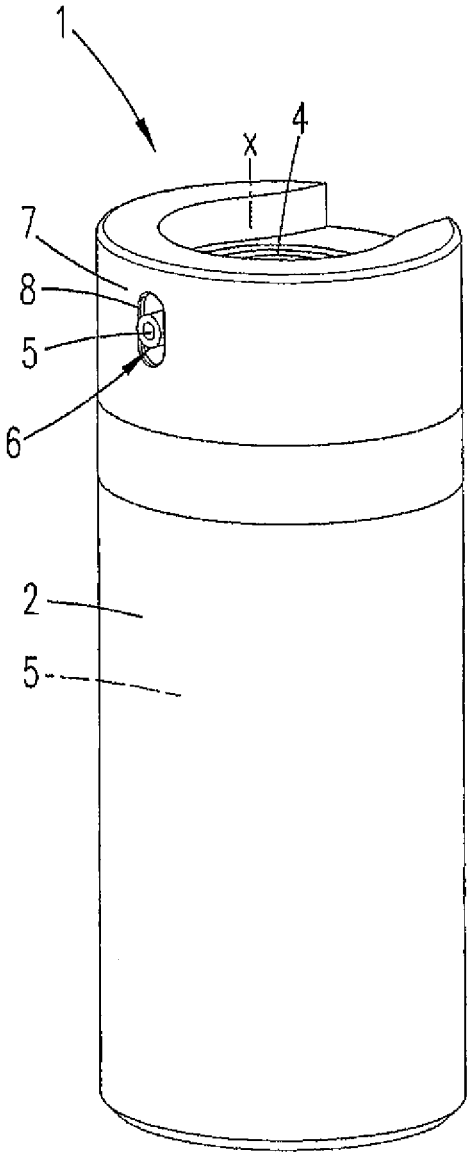

FIG. 10 shows an illustration of the dispenser according to FIG. 1 or FIG. 4 or FIG. 7 in the rest position; and FIG. 11 shows an illustration of the dispenser according to FIG. 1 or FIG. 4 or FIG. 7 in the actuating position, A dispenser 1, which has a bottom housing part 2 which also forms a storage chamber 3, and a top housing part 4 which is formed here as an actuating part, is shown and described in first instance with reference to FIGS. 1 to 3. Pressure is applied to the top of the housing part 4 with one or two fingers by a. user for the purpose of actuation. Associated with a dispensing opening 5 of the dispensing tube 6, the housing part 2 continues, preferably at the front, into a dispenser wall part 7 which is formed with an opening 8 in the region of the dispensing tube 6 or, in any case, the dispensing opening 5, at least as regards the actuating position.

After assembly, the housing part 4 is captively mounted on the bottom housing part 2, for example by means of retaining lugs 37 (compare second and third embodiments).

Furthermore, the dispenser 1 has a pump chamber 9, which in the exemplary embodiment is bounded by a stationary wall part 10 and a pump plunger 11 which is movable in the chamber. An inlet valve 12 associated with the storage chamber 3 is formed in the wall part 10. In the exemplary embodiment, the inlet valve 12 comprises a membrane part 13 which is mounted in the wall part 10 by means of a stopper part 14. One or more through openings 15 which are aligned with the membrane part 13 are formed in the wall part 10. When the pump plunger 11 moves back, this results in substance being drawn in from the storage chamber 3, and, as a result of a flexible bending away of the membrane part 13, being able to enter into the pump chamber 9 through the through openings 15.

Further through openings 16, which in a similar way are covered by a further membrane part 17, are formed in the pump plunger 11, The membrane part 17 is mounted by means of the plunger insert part 18. Together with the through openings 16, the membrane part 17 forms an outlet valve of the pump chamber 9, For the purpose of mounting, the plunger insert part 18 has a pressure portion 19, which, as preferred in the exemplary embodiment, acts centrally on the membrane part 17. On the side thereof, outlet openings 20 are formed in the plunger insert part 18 to provide a path for the substance to the dispensing tube 6. In the course of actuating the pump, that is to say during a movement, starting from FIG. 1, corresponding to FIGS. 2 and 3 and back, the end region of the dispensing tube 6, i.e., the region associated with the dispensing opening 5, moves in a direction perpendicular to the direction of the pumping movement P, in this case radially outwardly. In particular, it is apparent that the movement is a superimposed movement of a vertical movement and a radially outwardly directed movement relative to the pressing-down movement. When moving upwardly, that is to say the reverse movement sequence from the position of FIG. 3 via the position of FIG. 2 to the position of FIG. 1, at least in the mentioned region, the dispensing tube 6 likewise moves substantially perpendicularly with respect to the pumping movement P, but radially inwardly.

A covering part 21 is associated with the dispensing opening 5 of the dispensing tube 6. In the first exemplary embodiment of FIGS. 1 to 3, the covering part 21 is also moved during a pumping movement P, namely, in this exemplary embodiment, only vertically. The covering part is moved out of the covering position according to FIG. 1 into the uncovered position according to FIG. 3. This results in a linear movement path of the covering part 21.

In this exemplary embodiment of FIGS. 1 to 3, the movement of the covering part 21 is achieved in that the covering part 21 is connected directly to the top housing part, which is moved vertically during the pumping movement. It is apparent that the covering part is a portion of a skirt formed circumferentially on the top housing part. However, the skirt is interrupted in the region of the dispensing tube by a cutout 22 at the top. In the actuated state according to FIG. 3, the front region of the dispensing tube 6 projects through this cutout 22.

As is further apparent, a slot 23 in which there runs a sliding pin 24, which is connected to the dispensing tube 6, is formed in the skirt 21, offset around the circumference with respect to the cutout 22. The slot 23 is approximately hook-shaped with a rounded transition. Therefore it has a vertical leg 25 and a horizontal leg 26. In the exemplary embodiment, the horizontal leg 26 extends specifically (only) at an acute angle with respect to the vertical.

This arrangement of the vertical leg 25 and the horizontal leg 26 provides the movement characteristic of the dispensing tube 6 during a pumping movement. Initially, at the beginning of the pumping movement, the dispensing tube 6 is not moved although the top housing part 4 is moved downwardly. This corresponds to the movement as far as the position in FIG. 2. In the further progression, the dispensing tube 6 is then moved radially outwardly, namely, in the exemplary embodiment is swiveled until the top housing part 4 has reached the position according to FIG. 3.

As is further apparent, the dispensing tube 6 preferably has an angular shape, with a horizontal leg 27 and a vertical leg 28 ("horizontal" and "vertical" refer to the actuated position).

A return spring 29 acts between the pump plunger 11 and the top housing part 4, in the exemplary embodiment in particular between the plunger insert part 18 and the top housing part 4. The return spring 29 can be directly molded onto the top housing part 4. A further return spring 30 acts between the pump plunger 11 and the bottom housing part 2, in the exemplary embodiment in particular between the plunger insert part 18 and the wall part 10. The return spring 30 is the actual pump chamber return spring.

The dispensing tube 6, in the exemplary embodiment in its vertical portion 28, also has a pivot joint molding 31. The molding is cylindrical or spherical. This pivot joint molding 31 is accommodated in a corresponding mating pivot joint molding 32 of the plunger insert part 18. The pivot joint molding enables the dispensing tube 6 to execute the described swivel movement.

In the starting state according to FIG. 1, it can be seen that, with respect to a central longitudinal axis A, part of the dispensing tube 6 is disposed on one side of the longitudinal axis A and a further part is disposed on the other side of the longitudinal axis A, based on the cross-sectional drawing. The two portions of the dispensing tube 6 thus enclose an acute angle with the longitudinal axis A relative to their respective longitudinal extension.

While the vertical portion 28 is increasingly aligned vertically during a pumping movement P, i.e., as the top housing part 4 is being depressed, the horizontal portion 27 is increasingly aligned horizontally.

The front part of the dispensing tube 6 which has the dispensing opening 5 and which, in the fully depressed state of the top housing part 4 (see FIG. 3), projects beyond the covering part 21, has a projection length 1 which corresponds to one-tenth to five or more times the free diameter d of the dispensing tube 6 in the region of the dispensing opening 5. The projection length 1 also partially corresponds to a projection beyond a front side of the dispenser wall part 7. This projection can also vary within the stated range.

With a shorter dispensing tube, it is also possible for there to be no projection.

With regard to the disclosure, the specified ranges or ranges of values also include all intermediate values, in particular in 1/10 increments of the respective dimension, if appropriate also without dimensions, for example 1/10 mm, etc., on the one hand to delimit the stated range limits from below and/or above, and, alternatively or in addition, with regard to the disclosure of one or more individual values from a particular stated range.

Figure 5:
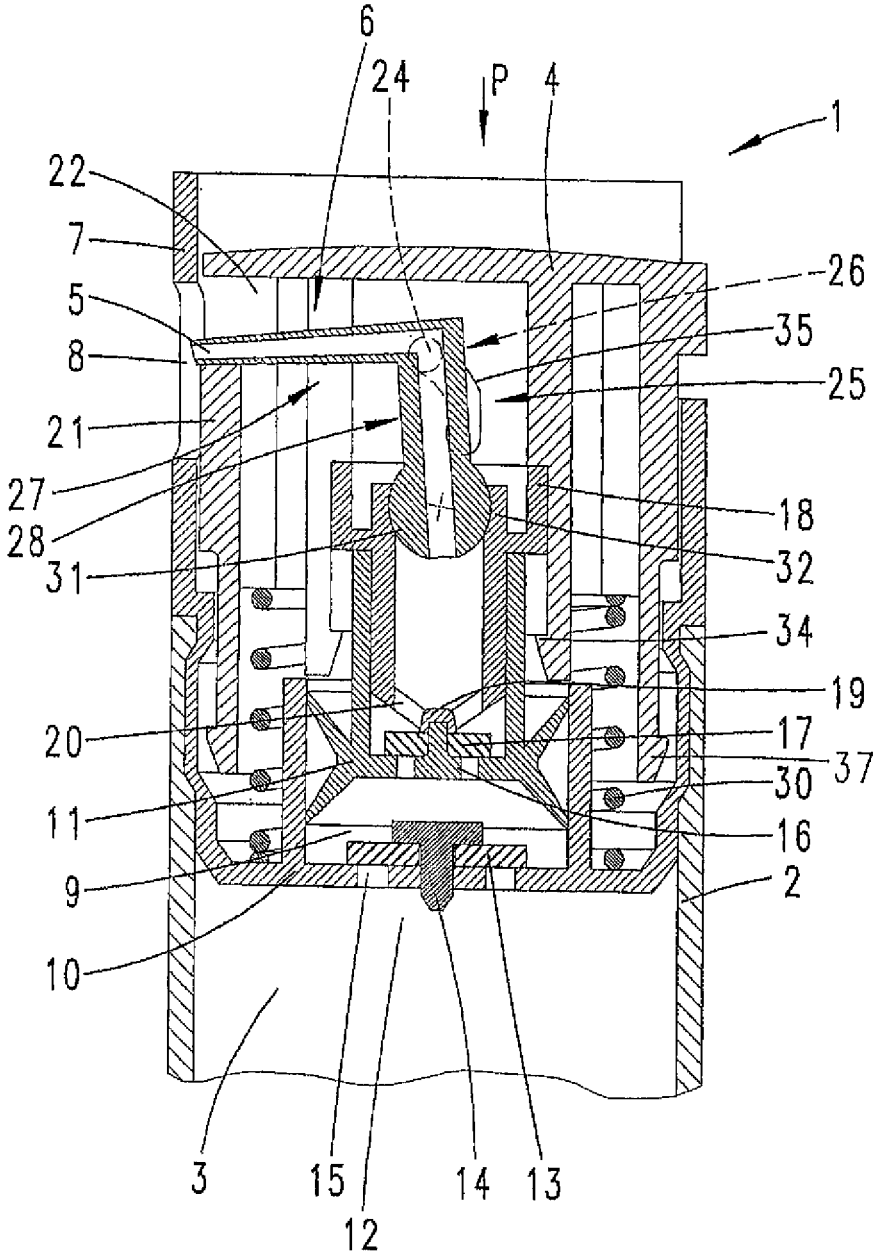
FIG. 5 shows an illustration corresponding to FIG. 2 of the embodiment according to FIG. 4.
Figure 6:
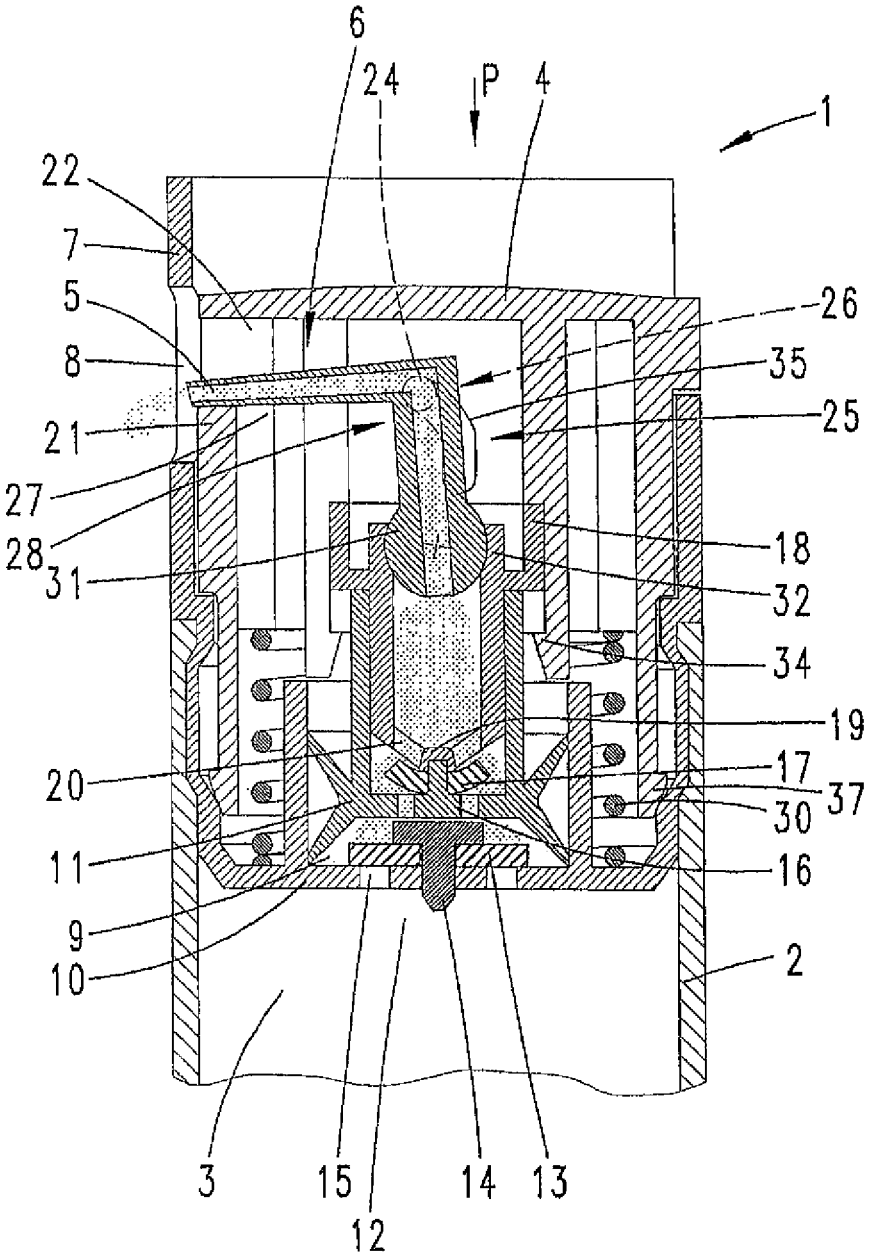
FIG. 6 shows an illustration corresponding to FIG. 3 of the embodiment according to FIG. 4.

A second embodiment is described with reference to FIGS. 4 to 6.

Parts which are not expressly described with reference to the second embodiment but which are apparent from the first embodiment are to be supplemented by the first embodiment with regard to the description.

Essentially, the description of the second embodiment concentrates on the differences from the first embodiment, which are identified here.

In the second embodiment, the part which forms the wall part 10 at the same time forms the dispenser wall part 7. Only one return spring, namely, the return spring 30, is provided. This return spring acts directly between the wall part 10 and the top housing part 4. The pump plunger 9 in the second embodiment is therefore pulled back into the starting position during the return stroke by a carrier 34 formed on the top housing part 4. The pump plunger 9 is depressed after a return stroke by action initially taking place by means of the top housing part 4 on the dispensing tube 6 only for the purposed of moving this tube. On completion of the return stroke (see FIG. 5), the top housing part acts on the pump plunger 9 by applying pressure to the dispensing tube 6, namely, in the exemplary embodiment with the plunger insert part 18 being positioned in between.

In the second exemplary embodiment, the movement of the dispensing tube 6 is also controlled by a slot, namely, by the slot 35.

A third exemplary embodiment is described with reference to FIGS. 7 to 9.

The same as for the second embodiment, the return spring 30 in the third embodiment is also provided directly between the movable top housing part 4 and the stationary bottom wall part 10, with regard to the latter however by way of a guide part 33. The guide part 33 forms an outer cylinder surface, which can form a guide for the return spring 30, for example during assembly. In addition, the guide part 33 forms an outwardly projecting flange 38 on the underside, on which the bottom of the return spring 30 rests.

The fixed part of the dispenser forms the slot 35. The horizontal leg 26 of the slot 35 extends at the top, starting from the vertical leg 25, in the opposite direction from the forward movement of the dispensing tube 6 in the course of actuating the pump. The horizontal leg 26 also serves to accommodate, in the rest position, the sliding pin connected to the dispensing tube 6, while in the actuated position, the sliding pin is located in the vertical leg 25.

Figure 8:
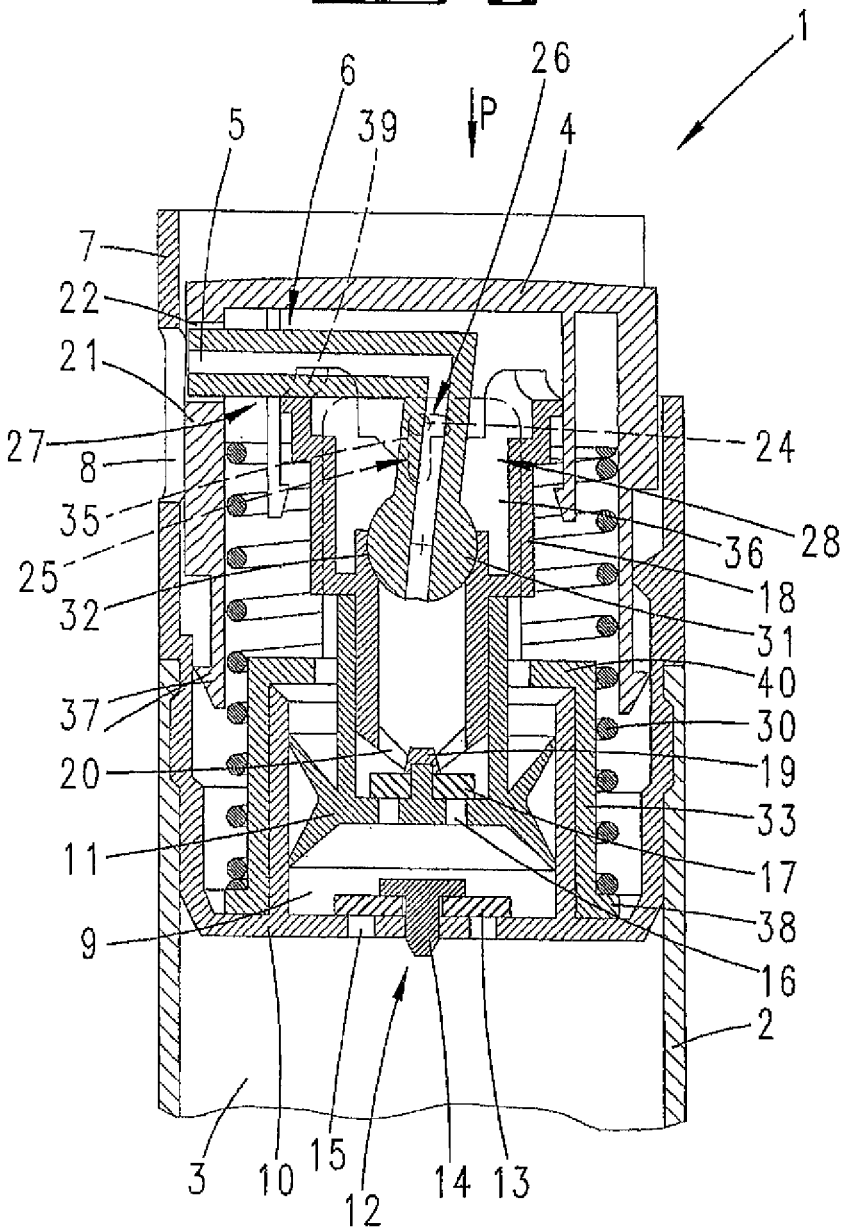
FIG. 8 shows an illustration corresponding to FIG. 2 of the embodiment according to FIG. 7.
Figure 9:
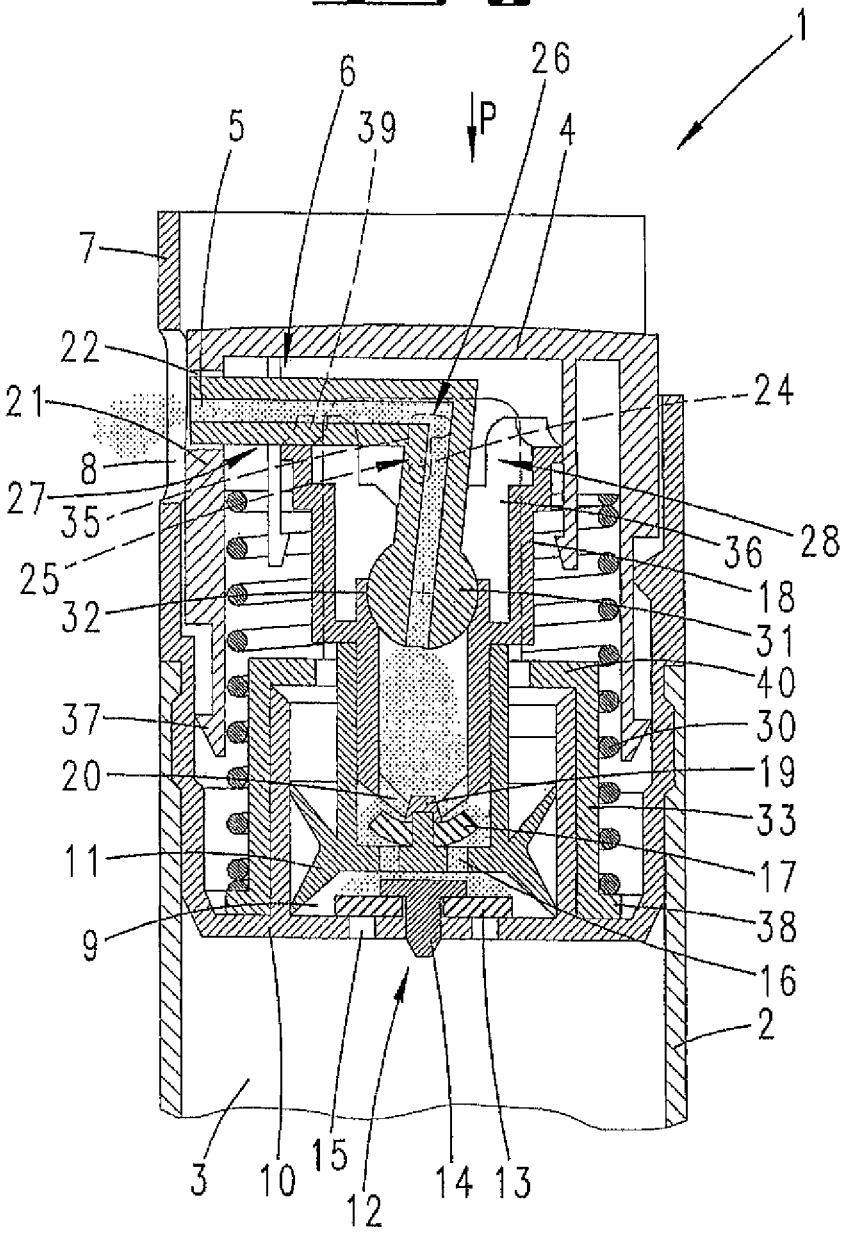
FIG. 9 shows an illustration corresponding to FIG. 3 of the embodiment according to FIG. 7.

At the top, associated with an underside of the dispensing tube 6, the pump piston or the pump insert part 18 forms a mounting 39 in which the dispensing tube 6 is partially enclosed in the descending position according to FIG. 8 and in the dispensing position according to FIG. 9.

Corresponding to the embodiments already described, the covering part 21 is connected directly to the housing part 4 with a window-like cutout 22 being positioned in between in the region of movement of the dispensing tube 6. The stationary housing part 36 is directly connected to or preferably also formed in one piece with the guide part 33. At the top, the guide part 33 has an extension 40 associated with its inner edge which in first instance projects inwardly; the housing part 36, which forms the slot, is molded on in a vertically upright manner As is particularly apparent from FIGS. 10 and 11, the covering part 21 is inwardly offset with respect to the dispenser wall part 7. Associated with the covering part 21, a window-like opening 8 is formed in the dispenser wall part 7. In the rest position according to FIG. 10, the covering part 21 is aligned with the window-like opening 8, even if on the inside, and in the dispensing position according to FIG. 8 the covering part 21 has at least uncovered the opening 8 to such an extent that part of the dispensing tube 6 is exposed in the opening 8 in order to discharge substance through the opening 8.

All features disclosed are (in themselves) pertinent to the invention. The disclosure content of the associated/accompanying priority documents (copy of the prior application) is also hereby included in full in the disclosure of the application, including for the purpose of incorporating features of these documents in claims of the present application. The subsidiary claims in their optional subordinated formulation characterize independent inventive refinement of the prior art, in particular to undertake divisional applications based on these claims.

LIST OF REFERENCE CHARACTERS

1 Dispenser
2 Bottom housing part
3 Storage chamber
4 Top housing part
5 Dispensing opening/delivery opening
6 Dispensing tube/delivery tube
7 Dispenser wall part
8 Cutout
9 Pump chamber
10 Wall part/wall plate
11 Pump plunger
12 Inlet valve
13 Membrane part
14 Stopper part
15 Through opening
16 Through opening
17 Membrane part
18 Plunger insert part
19 Pressure portion
20 Outlet opening
21 Covering part
22 Cutout
23 Slot
24 Sliding pin
25 Vertical leg
26 Horizontal leg
27 Horizontal position
28 Vertical leg
29 Return spring
30 Return spring
31 Pivot joint molding
32 Mating pivot joint molding
33 Guide part
34 Carrier
35 Slot
36 Dispenser fixed part
37 Retaining lug
38 Flange
39 Mounting
40 Extension
A Longitudinal axis
P Pumping movement
d Free diameter
1 Projection length

The invention claimed is:

1. A dispenser (1) for liquid to pasty substances, having a pump chamber (9) and a dispensing tube (6), the dispensing tube (6) being moved between a rest position and a dispensing position during a pumping movement (P) and in the rest position a dispensing opening (5) of the dispensing tube (6) being covered by a covering part (21) connected to the dispenser (1), wherein, in the course of actuating the pump by pressing in a vertical direction on an actuating part, which may be acted upon to carry out a pumping movement, the actuating part is interacting with the dispensing tube in order to move it, wherein further the covering part is part of the actuating part and moved together with the actuating part, at least part of the dispensing tube (6) is moved in a direction perpendicular to the pumping movement (P) while traversing the path of movement of the covering part (21), which at the same time is moved relative to the dispensing tube (6), wherein further the covering part (21) is inwardly offset with respect to a dispenser wall part (7), wherein a window-like opening (8) associated with the covering part (21) is formed in the dispenser wall part (7), wherein in the rest position the covering part (21) is aligned with the opening (8), and wherein in the dispensing position the covering part (21) at least partially uncovers the opening (8) and at least part of the dispensing tube (6) is exposed in the opening (8) in order to deliver substance through the opening (8).

2. The dispenser according to claim 1, wherein the dispensing tube (6) is swivelled.

3. The dispenser according to claim 1, wherein the covering part is moved in the vertical direction in the course of actuating the pump.

4. The dispenser according to claim 1, wherein the covering part is part of a covering wall.

5. The dispenser according to claim 1, wherein the dispensing tube (6) forms part of a swivel joint.

6. The dispenser according to claim 1, wherein a further part of a swivel joint is formed in a piston insert part (18).

7. The dispenser according to claim 1, wherein a movement of the dispensing tube (6) is controlled by a slot.

8. The dispenser according to claim 1, wherein the slot (23) is formed on a stationary part of the dispenser (1).

9. The dispenser according to claim 1, wherein the slot (23) is formed on a movable part of the dispenser (1).

10. The dispenser according to claim 1, wherein in a dispensing position the covering part (21) is at least partially covered on the outside by the dispenser wall part (7).

11. The dispenser according to claim 1, wherein during a pumping movement (P) the dispensing tube (6) serves to transmit force to a pump plunger (11).

* * * * *